US005951386A

United States Patent [19]

Martin

[11] Patent Number: 5,951,386

[45] Date of Patent: Sep. 14, 1999

[54] DART SHARPENER

[76] Inventor: Kim A. Martin, 1498 Audubon Blvd/, Delray Beach, Fla. 33444

[21] Appl. No.: 08/984,067

[22] Filed: Dec. 3, 1997

[51] Int. Cl.[6] ..... B24B 23/02; B43L 23/08

[52] U.S. Cl. ..... 451/358; 451/48; 451/344; 144/28.6

[58] Field of Search ..... 144/28.1, 28.2, 144/28.6, 28.72, 30; 451/48, 344, 358

[56] References Cited

U.S. PATENT DOCUMENTS

| | | | |
|---|---|---|---|
| 1,905,608 | 4/1933 | Schoenfeldt . | |
| 2,208,911 | 7/1940 | Premo . | |
| 2,851,009 | 9/1958 | Branvold . | |
| 3,092,081 | 6/1963 | Fraser . | |
| 3,882,642 | 5/1975 | Sykes . | |
| 4,069,528 | 1/1978 | Newton . | |
| 4,124,048 | 11/1978 | Fischer . | |
| 4,272,925 | 6/1981 | Graves . | |
| 4,512,111 | 4/1985 | Childers . | |
| 4,676,028 | 6/1987 | Kaczmarski et al. . | |
| 4,912,881 | 4/1990 | McDougall . | |
| 4,934,057 | 6/1990 | Chao . | |
| 5,056,265 | 10/1991 | Hurst | 451/358 X |
| 5,077,903 | 1/1992 | Kreim . | |
| 5,199,224 | 4/1993 | Aluotto . | |

FOREIGN PATENT DOCUMENTS

| | | | |
|---|---|---|---|
| 1102977 | 5/1955 | France | 144/28.72 |
| 219823 | 3/1910 | Germany | 144/28.6 |
| 816509 | 8/1951 | Germany | 144/28.72 |
| 568987 | 11/1957 | Italy | 144/28.72 |
| 575234 | 10/1977 | U.S.S.R. | 144/28.72 |
| 1266308 | 3/1972 | United Kingdom | 144/28.6 |

*Primary Examiner*—Timothy V. Eley
*Attorney, Agent, or Firm*—Patent & Trademark Services; Thomas Zack; Joseph H. McGlynn

[57] ABSTRACT

A dart sharpening apparatus having a holed upper cover end cap and a hollow main body member. Within the body member are a self contained battery power source and an electrically operated motor used to rotate a honing surface mounted within the end cap. One or more hone cap holes, three in one embodiment, permit the dart's end to be sharpened to be inserted into the cap's hole to engage the honing surface at different angular orientations. By pushing a button external to the body member a conductive strip is moved to engage and electrically connect the motor to the battery power source which results in the honing surface rotating.

5 Claims, 2 Drawing Sheets

FIG. 1
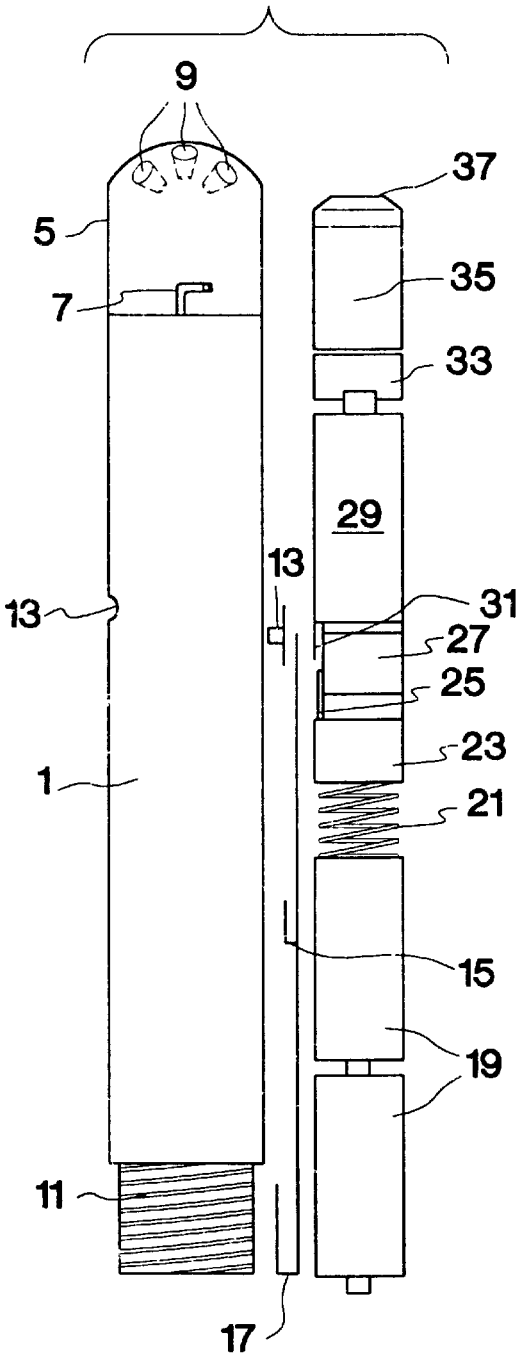
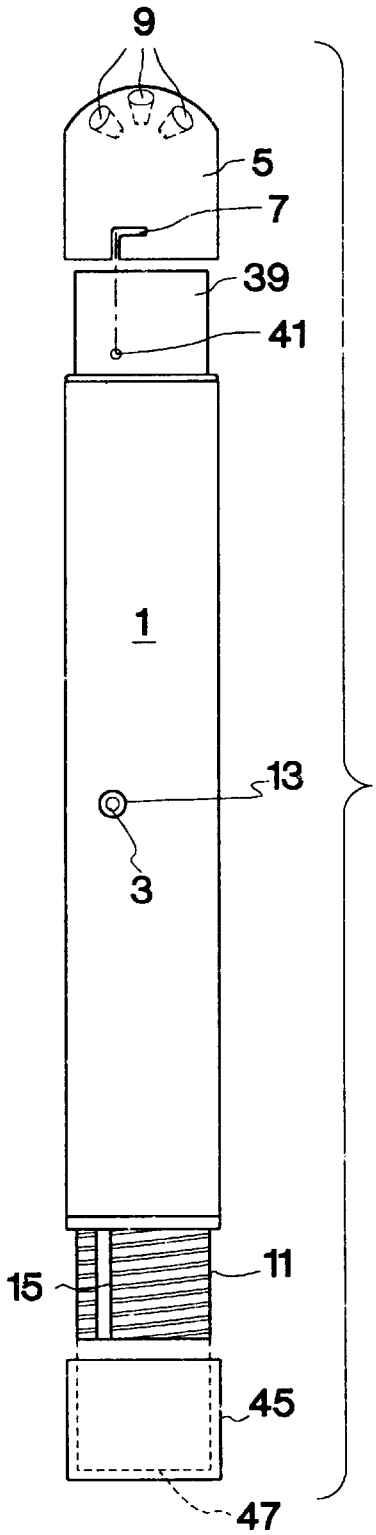
FIG. 2

DART SHARPENER

BACKGROUND OF THE INVENTION

Powered sharpening apparatus, especially for tools and knives, are found in many homes. Examples, include knife sharpeners combined with electrically operated can openers and rotating honing surfaces powered by alternating current (a.c.) powered electric motors. For their intended uses and purposes these edge sharpening devices are quite acceptable. When the object to be sharpened is the point of a throwing dart, such as used in the game of darts, such edge or point sharpening devices may not be practical or conveniently available due to their relatively large size. They may also be somewhat expensive to purchase and if they are operated by alternating current, need to have a convenience plug outlet for their a.c. power source. The present invention seeks to overcome most if not all of these deficiencies by providing for a self powered, relatively inexpensive dart sharpening apparatus that can be conveniently carried by a user and which is specifically designed to sharpen the inserted dart point all as more fully described in this specification.

DESCRIPTION OF THE PRIOR ART

Edge sharpening apparatuses are known. For example, in U.S. Pat. No. 3,882,642 to Sykes a knife sharpener is disclosed having a pair of parallel legs with an angled V-shaped notches which slides on the top of a box holding a sharpening stone as the blade to be sharpened rests in the notches.

The Childers invention (U.S. Pat. No. 4,512,111) describes a knife blade sharpener wherein the knife is supported on a movable saddle support member and the knife blade maintained a set predetermined angle with respect to a sharpening stone.

The McDougall reference (U.S. Pat. No. 4,912,881) discloses a device that assists in manual abrading dressing at a selected angle of the edges of tools and other materials.

In the U.S. Pat. No. 5,199,224 to Aluotto an apparatus for sharpening a dart is disclosed having a sharpening stone and a dart holder. As the held dart is moved across the stone it is rotated against the stone in a direction opposed to the translation. The present invention differs from these inventions and the known prior art by providing for a portable power driven dart sharpening apparatus having its own self contained power source within a conveniently carried housing all as more further set forth in this specification.

SUMMARY OF THE INVENTION

This invention relates to a dart sharpener apparatus having a rotatable hone powered by an electric motor with a self contained power source within a common housing. A removable hone cover with a plurality of different angular bored holes is mounted over the rotating hone permitting the dart's end point to be inserted into the cover and to engage the hone to provide a sharped dart point edge honed at an angle corresponding to the angle of the cover bore hole.

It is the primary object of the present invention to provide for an improved apparatus to sharpen dart points.

Another object is to provide for such an apparatus having an internal rotatable sharpening hone with its own self contained power source.

These and other objects and advantages of the present invention will become apparent to readers from a consideration of the ensuing description and the accompanying drawings.

BRIEF DESCRIPTION OF THE DRAWINGS

FIG. 1 is a front view showing the preferred embodiment housing and its internal components.

FIG. 2 is an exploded side view of the FIG. 1 housing with its upper hone cover removed and an added lower end cap removed.

DESCRIPTION OF THE PREFERRED EMBODIMENT

Figure 4:
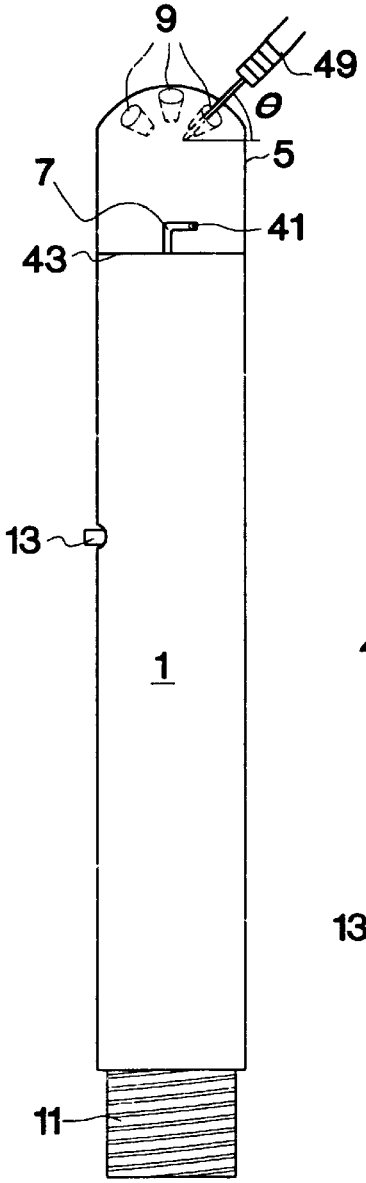
FIG. 4 shows a front view of the assembled apparatus with three angular bore holes in the hone cover end cap with an inserted dart to be sharpened.

FIG. 1 is a front view showing the preferred embodiment housing and its several internal components located in an unassembled state to the right outside of the housing. The main body portion of the hollow elongated tubular housing 1 has a small hole 3 along its wall side which extends into the hollow interior of the housing. The housing main body has its longest measurement lengthwise (i.e., vertical in this figure) and is generally straight in this direction. In outward appearance the housing resembles a hand-held flashlight body in both size and appearance.

Mounted on the upper opened end portion of the body member 1 is a dome shaped hollow cover end cap 5 having a side wall bayonet style right angled slot 7 used to help attach this cover to the main body member 1. This side slot has both an opened lower vertical portion and a joined horizontal portion. At the top domed portion of the end cap 5 are three holes 9 bored into and through the end cap at different angular bores with respect to the straight length of the body 1. It is in these holes that the dart's end is inserted for sharpening. At the opposite lower end of the main body member 1 there is a joined externally threaded cap retaining body section 11 having a diameter slight less than the diameter of the main tubular body portion 1.

Figure 3:
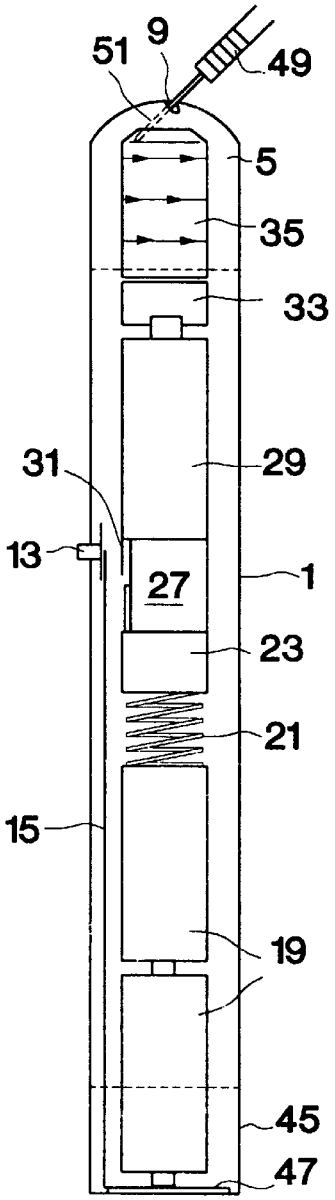
FIG. 3 shows a front sectional view of the assembled components within the housing with several of the housing's front facing sections removed.

Also illustrated in FIG. 1 are the several internal components which are mounted within the body of the apparatus shown to their left including the main body 1 with its threaded extension 11 and the hollow cap cover 5, as best shown in FIG. 3. These internal components include the extending push button 13 with its enlarged ends which, when assembled, extends from within the main body through the body's side hole 3 while the button's enlarged ends remain within the main body 1.

Also shown are the electrically conductive elongated straight brass strip 15 with its lower bent U-shaped end 17. This conductive strip is contacted at its upper end by the button 13 which can be depressed by a user. Two conventional 1.5 volt long life alkaline batteries 19 are serially engage each other end-to-end to provide for a self contained source of electrical direct current power. Continuing with the internal components, there is a metallic coil spring 21 which presses against the surface of the upper battery to retain it in place within the hollow body member 1. Above this coil spring is a spacer 23 that electrically isolates the batteries.

A side rubber strip 25 is mounted on another insulated cylindrical spacer 27 to provide a soft resilient backing surface to bend the brass strip 15 when the push button's 13 enlarged end is pressed against this backing in the assembled state. Shown further up in this figure is the small conventional direct current operated electric motor 29 which fits entirely within the body 1. Located on the lower end of this electric motor is the motor's electrical contact strip 31 which provides an electrical input path to the motor when the button 13 is depressed to bear against the conductive strip 15 which strip 15 in turn engages this contact motor strip 31 to complete a circuit to the lower battery power sources 19.

At the upper end of the motor is a rotatable spacer 33 which receives the motor's central output shaft and rotates therewith. A hollow protective motor cover (not shown) cylindrically shaped and opened on both ends may fit over the motor and is approximately the same in overall length. Seated within the spacer 33 is the cylindrically shaped hollow sandstone honing surface 35 (i.e. grit surface used to sharpen) used to engage and sharpen the dart's engaged end point. As the spacer 33 rotates this mounted sandstone surface hone 35 rotates in unison with it. Above the hone 35 is a flat center holed donut shaped hone bearing 37 which fits over the hone top end and acts as a protecting member to receive the dart's end to prevent abuse of the hone when pushing down hard on the dart against the cover's 5 wall.

FIG. 2 is an exploded side view of the FIG. 1 housing with its top cover removed. The top cover 5 and an added lower end cap 45 are also removed from the body 1 in this figure. Those internal assembled components bear the same numbers as in FIG. 1 but may be oriented at slightly different angles due to the view. Located on and joined to the upper part of the main body 1 is a slightly smaller diameter hollow tubular extension section 39 having opened ends.

Extending outwardly from the side of the section 39 is the lock pin 41. This lock pin is configured to engage the cap slot 7 and is used to lock the cap 5 when in place on section 39. Pin 41 is inserted into the opened end of the slot 7 to lock the cap in place. By turning the cap 5 with respect to the section 39, the lock pin fits into the right angled or horizontal portion of the slot 7 to lock the two members 1 and 5 together. A flat rubber O-ring 43 is seated in a circular ledge formed where the smaller diameter section 39 joins the larger diameter main body 1 and is fitted against the lower surface of the engaging cap's opened lower end. The push button 13 is shown protruding from the main body 1 through the hole 3 in this side view.

Extending from the lower portion of main housing body member 1 is the lower part of electrically conductive strip 15 which fits over the threaded lower end extension 11. The internally threaded end cap 45 is configured to engage the external threads on end member 11 to retain the inserted batteries in place. Located at the bottom of the cap 45 is a brass plate 47 (shown by dotted lines) which acts, when the cap is screwed on the member 11, as the positive end contact for the lower battery as this plate also engages the end portion of the shown elongated side conductive strip 15.

FIG. 3 shows a front sectional view of the assembled components within the housing with the facing front wall sections of the main housing 1, the hone cover cap 5 and the end cap 45 removed to show the internal assembly of the components. The throwable hand held dart 49 (partially shown) has its lower pointed end 51 engaging the rotating sandstone hone 35 surface when inserted through one of the three angled holes (only one shown) in the sectionalized end cap 5.

To provide for the hone's rotation the button 13 is depressed moving the end of conductive strip 15 into contact with the motor's end strip 31 which then provides electrical power to actuate the motor 29 by being electrically connecting it to the lower battery power source. The inherent resilient spring nature of the metallic conductive strip 15 causes the circuit to be broken once the button 13 is no longer depressed which in turn causes the rotation of the hone to cease as electrical power is disconnected to the electric motor.

FIG. 4 shows a front view of the assembled apparatus with its three angular holed cover end cap sharpening an inserted dart 49. In this view the lower end cap 45 has been omitted from the figure. The three spaced bore holes 9 in the cap 5 are oriented at different angular bores with respect to the surface of the interior rotating hone to permit a user to vary the angular engagement of the dart's engaging point 51 with the rotating sandstone hone 35.

In one embodiment these bore holes had angular bores of 40, 60 and 80 degrees as measured from a line extending perpendicular to the vertical length main body member 1. By using different angular bores different bearing engagements with the hone bearing angles are permitted. The shown variable angle f represent this measured value for one of the bore holes. It is anticipated that this angular orientation of said cap holes will vary between 25 to 85 degrees. Also, to be noted is the locking engagement of the lock pin 41 within the cap's horizontal section of the right angled slot 7 to join the cap 5 to the main body 1.

Figure 5:
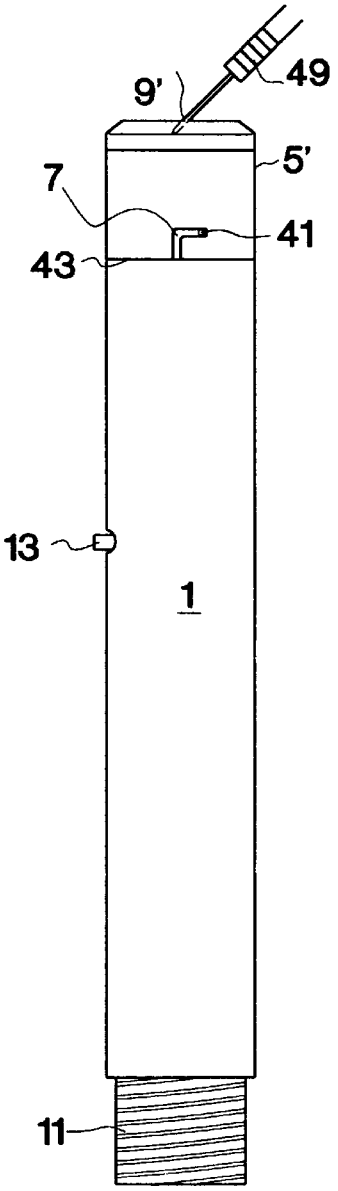
FIG. 5 shows a front view of the same assembled apparatus as in FIG. 4 except that there is a single hole in the cover end cap with the dart inserted.

FIG. 5 shows a front view of the assembled apparatus with a single hole cover end cap sharpening an inserted dart. As in FIG. 4, the lower battery retaining end cap 45 has been omitted from the this figure. Except for the hone cap 5' with its single hole 9' this figure is essentially the same as FIG. 4. The single hole 9' is larger in diameter than any of the individual bore holes 9 thus permitting a user more latitude in manipulating the hand held dart 49 such that its inserted hone engaging end 51 may contact the honing surface at several different angular relationship depending on how the dart body is oriented by the user's hand.

To assembly the various components shown the push button 13 is first inserted by sliding it into the hollow of body 1 until its smaller diameter portion protrudes from the hole 3. A scriber or small pointed object may be used for this purpose. Next, the major components are inserted into the hone end of the body 1 starting with the coil spring 21, then the spacers 23 and 27, the motor 29, the member 33 and the hone 35. The strip 15 needs to be lined up with the ground contact and the hole 3 and the hone cover 5 should not hang up on the top edge of the body 1. The push button should be kept down during this process as the end of strip 15 engages the motor's strip 31.

When the brass strip 15 buckles, the batteries may be inserted from below with the batteries negative terminal ends first. Next, the lower cap end 45 is screwed on to extension 11 and lastly, the hone cap 5 is twisted in place on the body extension 39 and its lock pin 41. To disassemble the the assembled unit the user first takes of the battery end cap 45 by turning it. Next, the two inserted batteries are slide out of the now opened lower end similar to removing batteries from a flashlight. The hone cover end cap 5 is then removed by twisting it relative to the body 1 until the lock pin 41 is in the vertical section of slot 7 and then pulling the members apart. After this takes place, the motor 29 is slide out or, if necessary, a slender rod is inserted through the opened lower end 11 to push it out. The push button 13 should face towards the ground to prevent it from falling out. Next, remove the brass contact strip 15 and the then the push button. After this only the main body 1 with its O-ring 43 are left.

The main body including its upper and lower reduced diameter sections 39 and 11, respectively, the spacers, the button 13, the two caps 5 and 45 should all be made of an electrically nonconductive material such as plastic.

Although the present invention's preferred embodiment and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. An apparatus for sharpening an inserted dart end surface comprising:

a main housing having a hollow body portion, said body having a straight length and two opposite opened ends, said housing having a first end cap mounted on one of said body's two opposite opened ends to substantially cover over said end, said first end cap having a plurality of spaced holes oriented at different angular relationships with respect to the straight length of the main body portion, each of said holes being adapted to separately receive the end of a dart inserted into the hole;

a self contained source of electrical power mounted in said hollow body;

an electrically operated motor mounted within said hollow body and having a rotatable output member;

a rotatable member with a honing surface operatively associated with the motor's rotatable output member and rotatable in unison therewith, said honing surface being positioned under the first end cap within the housing to receive the pointed end of an inserted dart for sharpening the pointed dart end as the dart end engages the rotating honing surface; and means including a button receiving hole in the side of the body with a pushable button inserted the hole for electrically connecting the self contained electrical power source to the electrically operated motor whereby the rotation of the motor's output member and honing surface can sharpen a dart end inserted into one of the holes in the first end cap.

2. The apparatus as claimed in claim 1, wherein said means for electrically connecting the electrical power source to the electrical motor also includes an electrically conductive strip extending from the electrical power source to the electric motor.

3. The apparatus as claimed in claim 1, also including a second end cap mounted on the body's end opposite the first end cap for retaining the electrical power source within the hollow body.

4. The apparatus as claimed in claim 1, wherein the angular orientation of said plurality of spaced cap holes varies between 25 to 85 degrees with respect to the length of the body.

5. The apparatus of claim 1, wherein said plurality of spaced holes oriented at different angular relationships with respect to the straight length of the main body portion includes at least three different holes.

* * * * *